US005209587A

United States Patent [19]

Herbert et al.

[11] Patent Number: 5,209,587

[45] Date of Patent: May 11, 1993

[54] INK RIBBON FEED

[75] Inventors: Raymond J. Herbert, Leigh-on-Sea; Thomas D. Williams, Billericay, both of United Kingdom

[73] Assignee: Alcatel Business Systems Limited, Essex, United Kingdom

[21] Appl. No.: 814,454

[22] Filed: Dec. 30, 1991

[30] Foreign Application Priority Data

Dec. 31, 1990 [GB] United Kingdom ..... 9028224

[51] Int. Cl.[5] ..... B41J 33/14

[52] U.S. Cl. ..... 400/225; 400/208

[58] Field of Search ..... 400/225, 120, 223, 234, 400/236, 236.2, 207, 208, 227, 227.1, 227.2, 232, 235, 235.1

[56] References Cited

U.S. PATENT DOCUMENTS

| | | | |
|---|---|---|---|
| 3,998,313 | 12/1976 | Hickey | 400/616.2 |
| 4,025,830 | 5/1977 | Delaporte | 400/225 |
| 4,091,913 | 5/1978 | Ku et al. | 400/124 |
| 4,705,417 | 11/1987 | Harry | 400/208 |
| 4,813,802 | 3/1989 | Gilham et al. | 400/74 |
| 4,821,644 | 4/1989 | Gawler | 400/154.4 |

FOREIGN PATENT DOCUMENTS

| | | | |
|---|---|---|---|
| 0096889 | 6/1982 | Japan | 400/234 |
| 0115367 | 7/1982 | Japan | 400/120 |
| 0125383 | 5/1988 | Japan | 400/234 |
| 2214133 | 8/1989 | United Kingdom . | |
| 2227460 | 8/1990 | United Kingdom . | |

OTHER PUBLICATIONS

W. M. Jenkins "End of Ribbon Sensor and Cartridge Present Indicator" IBM Technical Disclosure Bulletin vol. 27, No. 6 Nov. 1984.

*Primary Examiner*—Edgar S. Burr
*Assistant Examiner*—Anthony H. Nguyen
*Attorney, Agent, or Firm*—Shoemaker and Mattare Ltd.

[57] ABSTRACT

A ribbon feed for a thermal ink transfer ribbon (14) is disclosed in which the ribbon is drawn from a supply spool (15) and, together with an article (17) such a mail item on which printing is to be effected, is fed past a thermal print head (12). A tachometer (45) is coupled to the feed to generate pulses as the item is fed. A sensor (33, 34) generates pulses as the spool (15) rotates due to drawing of the ribbon therefrom. The number of sensor pulses occurring in periods determined by the tachometer pulses is compared with a predetermined value to provide to enable detection of occurrence of a fault in the ribbon feed from the spool.

11 Claims, 3 Drawing Sheets

INK RIBBON FEED

BACKGROUND OF THE INVENTION

This invention relates to feeding ink ribbons and in particular to detection of faults in feeding of the ribbon.

Ink ribbons for printing on a print receiving medium are commonly fed from a supply spool past a printing head where printing is effected and then the used ribbon is wound onto a take-up spool. Means are often provided to detect when the end of the ribbon is approaching so as to provide an indication that the supply of ribbon is exhausted. If the ink ribbon supply is exhausted, continued operation of the print head will not result in printing on the print receiving medium. For many printing applications interruption of printing of a block of printing, such as printing of a sheet, is an inconvenience but otherwise is of little importance and at worst in the event of such an occurrence, after replenishment of the ink ribbon supply, the sheet can be reprinted.

However in a franking machine for printing franking impressions on mail items, it is required that when a printing cycle has been initiated sufficient ribbon is available for use to print the entire franking impression. Otherwise, if the ribbon should become exhausted during printing of the franking impression, only a partial franking impression would be printed and this would be unacceptable as a franking of the mail item while accounting for the value of the postage charge would have been completed prior to commencement of printing.

If the path of travel of new ink ribbon from the supply to the print head is of sufficient length a sensor to detect the end of the ribbon can be positioned a sufficient distance from the print head to provide a signal indicating that the supply of ribbon is exhausted while a length of ribbon sufficient to print an entire franking impression is contained in the path of travel between the sensor and the print head. However in order for the franking machine to be compact and of convenient overall size it is required that the ribbon supply spool is positioned closely adjacent the print head. As a result the length of ribbon required to print a franking impression may be wrapped a number of times round the supply spool and accordingly sensing of the end of the ribbon is difficult.

SUMMARY OF THE INVENTION

According to a first aspect of the invention a ribbon feed mechanism includes means for drawing an ink ribbon from a spool of wound ribbon past a print head; first means responsive to movement of the ribbon past the print head to produce first signals representing increments of movement of the ribbon; second means responsive to rotation of the spool to produce second signals representing increments of angular rotation of the spool and control means operative to count the number of first signals occurring during an interval defined by said second signals and to compare said count with a predetermined reference value.

According to a second aspect of the invention a thermal printing device includes a ribbon feed mechanism as hereinbefore defined.

According to a third aspect of the invention a franking machine includes a thermal printing device as hereinbefore defined.

BRIEF DESCRIPTION OF THE DRAWING

An embodiment of the invention will now be described by way of example with reference to the drawings in which.

DESCRIPTION OF THE PREFERRED EMBODIMENT

Figure 1:
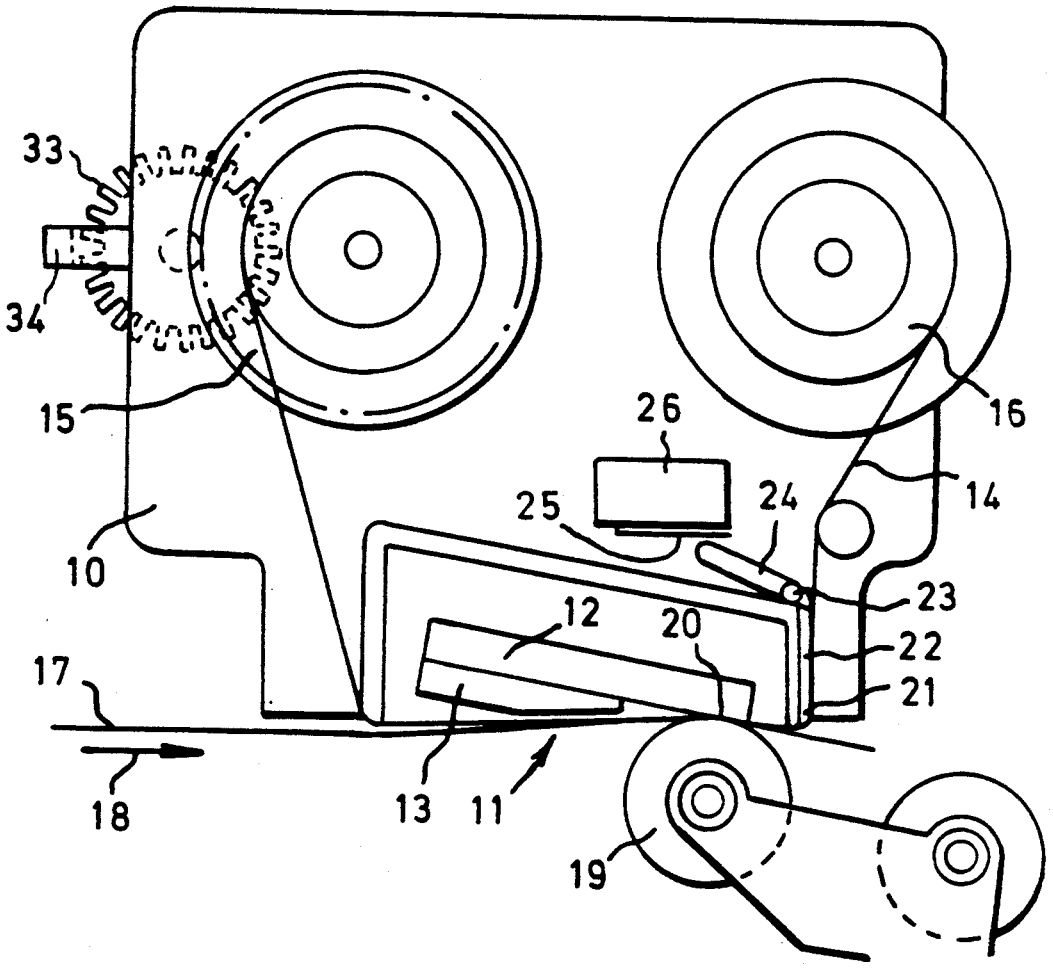
FIG. 1 is a view of a thermal transfer printing device.

Referring first to FIG. 1, a thermal transfer printing device comprises a thermal print head 11 and a thermal transfer ink ribbon cassette 10. The thermal print head 11 comprises a substrate 13 carrying a line of thermal printing element which are selectively energised with electric currents by means of print head drive circuits 13. The thermal transfer ink ribbon cassette includes a spool 15 of unused ink ribbon 14 from which the ribbon is drawn in a printing operation and a spool 16 to take up used ribbon after it has been used in printing. The thermal transfer ink ribbon 14 comprises a backing layer carrying a layer of ink and the ribbon is fed from the supply reel 15 past the thermal printing elements of the print head 11 to take up reel 16. A mail item 17 such as an envelope or postage label is fed, in the direction of arrow 18, past the thermal printing elements of the print head 11 and is pressed toward the thermal printing elements by means of an impression roller 19. The thermal transfer ink ribbon 14 is guided by guides 27, 28 and passes between the mail item and the print head. The thermal printing elements are disposed along a line, indicated by reference 20, parallel to the axis of impression roller 19 so that the printing elements lie on a line on which the impression roller exerts pressure toward the print head. As the mail item 17 is fed past the print head, in engagement with the ink layer of the ribbon 14, frictional engagement between the mail item and the ribbon causes the ribbon to be pulled along by the mail item. As the mail item and the ribbon are fed past the print head, the thermal elements of the head are energised selectively to cause selective heating thereof such that those elements which are energised heat areas of ink adjacent to the heated elements and thereby cause those areas of ink to be transferred to the surface of the mail item. Successive selective energisations of the elements during feeding of the mail item builds up, line by line, a desired printed pattern on the mail item. Feeding of the mail item causes the ribbon to be pulled from the supply reel 15. After passing the print head the ribbon is guided by guide 28 to the take up spool 16. A motor drive is coupled through a slipping clutch to the take up spool to rotate the spool to take up the used ribbon. The feed path of the ribbon from the guide 28 to the take-up spool 16 extends at an angle to the path of the mail item so that by applying tension to the ribbon through rotation of the up spool, the ribbon is peeled from the surface of the mail item.

During printing of the franking impression, the impression roller 19 is resiliently urged toward the thermal elements of the print head to maintain the mail item in intimate contact with the ink layer of the ribbon 14 and to maintain the ribbon in heat transfer relationship with the thermal elements. The contact between the mail item and the ribbon causes the ribbon to be drawn from the supply spool and to be fed at the same speed as the mail item. When printing of the franking impression by successive selected energisations of the printing elements has been completed, the impression roller is moved away from the print head. The impression roller is mounted in a cradle 29 pivoted about an axis 30 and by pivoting of the cradle the impression roller is moved between its operative position resiliently urged toward the print head and an inoperative retracted position.

A sensor device is provided between the guide 28 and the take up spool which is responsive to tension in the used ribbon to control energisation of drive to the take up spool. The sensor device includes a guide surface 21 on the end of a pivoted flap 22 mounted adjacent the guide 28. The flap is pivoted at 23 and is provided with an extension arm 24 which engages an operating lever 25 of a microswitch 26. The microswitch includes a spring resiliently urging the operating lever in a clockwise direction, as shown in the drawings, and through the engagement between the lever 25 and the extension 24 resiliently urges the flap 22 in an anti-clockwise direction. When drive is applied to the take-up reel 16, tension is applied to the ribbon and this tends to pivot the flap in a clockwise direction, against the action of the microswitch spring, to lie against the guide 28 as shown in FIG. 1. When the flap approaches the guide 28, the arm 24 depresses the lever 25 and thereby operates the microswitch to terminate energisation of the drive to the take up spool 16. Initially at the start of printing a franking impression, the pressure roller is in a retracted position and the mail item is fed into the gap between the pressure roller and the print head. The pressure roller is then raised to its operative position to press the mail item toward the print head. Accordingly as the mail item and the ribbon drawn thereby are fed past the print head, the ribbon between the print head and the take-up spool becomes slack and the flap 22 is freed to pivot anti-clockwise away from the guide 28. This releases the lever of the micro-switch to permit the micro-switch to re-energise the drive for the take-up spool and after a short delay the drive to the take up spool is energised. Thus during a printing operation in which the ribbon is drawn by the feeding of the mail item, the drive to the take-up spool is repeatedly energised and de-energised to alternately tension and permit slackness in the ribbon. The control of the energisation of the take up spool drive in dependence upon sensing of the ribbon tension by the sensor prevents excessive over-travel of the ribbon when the mail item is released by the impression roller. A fixed guide or roller 31 is provided to define the direction in which the ribbon is pulled as it leaves the guide 28 so that the direction of application of tension to the ribbon is constant regardless of the diameter of wound ribbon on the spool 16. Instead of utilising a micro-switch to provide an indication of the position of the sensor flap 22 other devices such as an opto-sensor or a hall effect device may be used. The sensor flap 22 may be provided as a component of the ribbon cassette while the micro-switch or other device may be mounted on the frame of the franking machine. When using devices which do not incorporate a spring, a spring is provided to urge the flap to pivot against the tension in the ribbon. Alternatively, the sensor may be designed such that the action of gravity on the elements thereof provides the required force to urge the flap to pivot against the ribbon tension. The provision of the sensor device and the utilisation thereof to control energisation of the drive for the take up spool is the subject of our copending patent application entitled "Ink Ribbon Feed" filed on the same date as the present application.

As hereinbefore described it is envisaged that initially, the supply spool is filled with ribbon and that in the course of printing operations in which franking impressions are printed the ribbon is successively transferred to the initially empty take up spool. However the ribbon feed may be operated in such a manner that initially the spool 16 is full of unused ribbon and that prior to printing each franking impression a length of ribbon sufficient to enable printing of that printing impression is present on the spool 15. Thus during printing of each franking impression the ribbon is drawn from the spool 15 and wound onto spool 16 as hereinbefore described but in an interval between printing of successive franking impressions the ribbon is fed in the reverse direction to provide a sufficient length of ribbon on the spool 15 for ink transfer for the next franking impression.

To accomplish the reverse feeding of the ribbon during intervals between printing a drive is provided for the spool 15 and this drive is energised during reverse feeding to draw ribbon from the spool 16.

It will be appreciated that the ribbon cassette is removable from the franking machine to enable replacement of the cassette with a cassette containing unused ribbon when required. Conveniently the flap 22 is mounted on the cassette and the micro-switch 26 is mounted on the frame of the printing apparatus. The extension arm 24 has a form such that it extends from the cassette to engage the operating lever of the microswitch.

Instead of housing the ribbon in a cassette, the ribbon may be provided on spools or reels which can be removably mounted on the franking machine. Whichever manner of providing for replacement of the ribbon is utilised, the franking machine is provided with drive means to engage and drive one or both of the spools.

Figure 2:
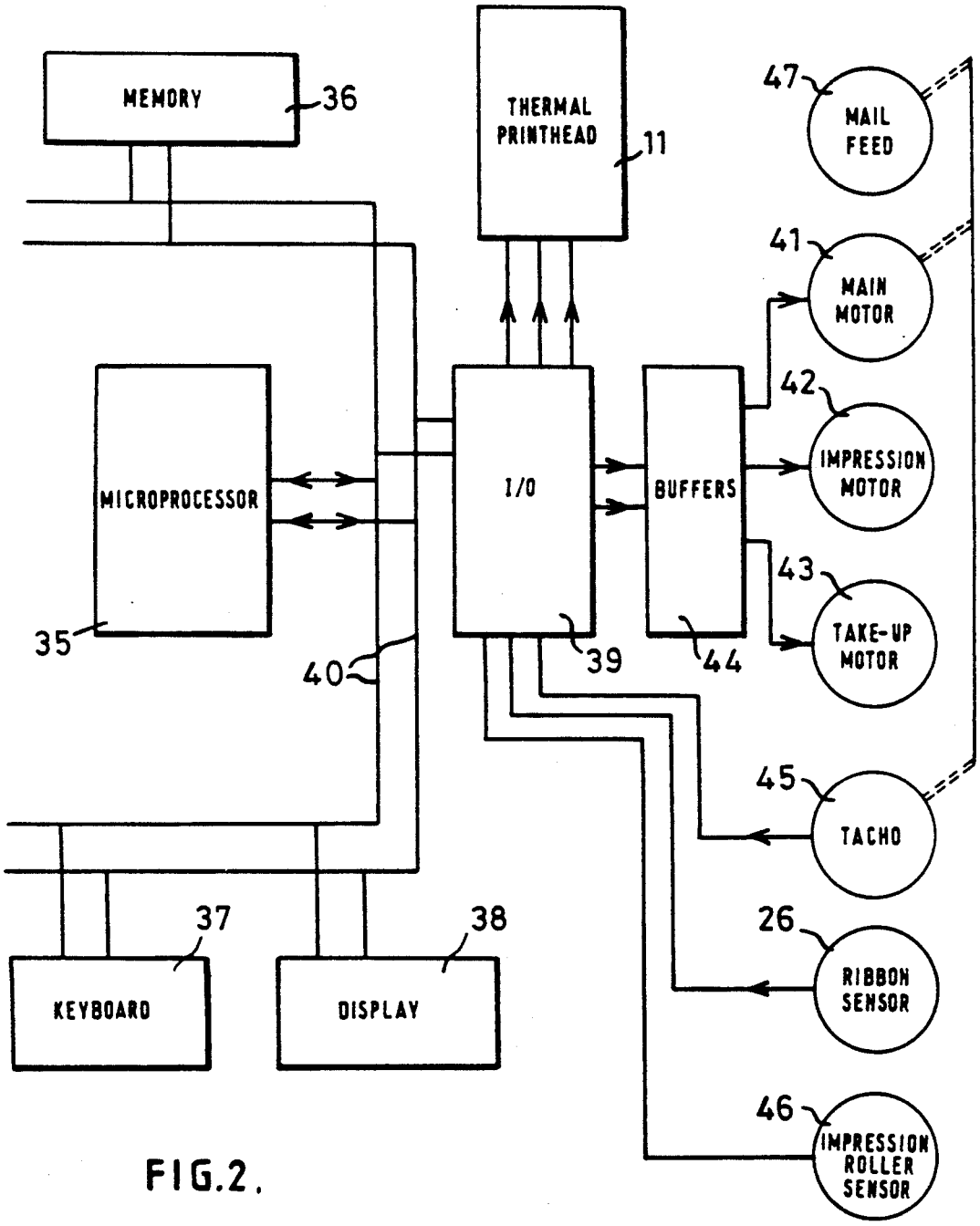
FIG. 2 is a block diagram of a control circuit for a franking machine incorporating the printing device of FIG. 1.

Referring now to FIG. 2, the franking machine includes a micro-processor 35 which carries out control and accounting functions under the control of one or more program routines stored in memory 36. Data such as required postage values and control signals are input to the microprocessor by means of a keyboard 37 and information output by the microprocessor for display to a user of the franking machine is displayed by a display device 38. Print data output signals from the microprocessor for control of operation of the thermal printing elements 20 of print head 11 are transmitted to the print head drive circuits 13 via an input/output interface 39. Although the memory 36 is shown as a single block it includes separate memory devices including a read only memory for storing program routines for control of operation of the microprocessor and non-volatile memory devices for storing accounting data. As is well known in the franking machine art, the non-volatile memory devices for accounting data are arranged to store a number of replications of the data to enable integrity of the data to be checked and to recover the accounting data in the event of a fault. The memory 36, keyboard 37, display 38, input/output interface 39 are connected to the microprocessor 35 by means of a common bus 40. A motor drive 41 for driving means 47 for feeding the mail item 17 past the print head, a motor drive 42 for moving the cradle 29 of the impression roller and a motor drive 43 for rotating the take up spool 16 are energised selectively by drive control signals output from the microprocessor via the input/output interface 39 and buffers 44. Where drive is required to be applied to the spool 15 a further motor drive (not shown) is provided and connected to the buffers 44.

A tachometer 45 is coupled to the feed means 47 for the mail item to generate pulses as the mail item is fed past the print head which are input to the microprocessor 35. The microprocessor utilises the pulses from the tachometer to strobe energisation of the print head elements to ensure that successive energisations of the thermal printing elements is synchronised with movement of the mail item. Thus the strobing of the print elements in dependence upon the timing of the pulses from the tachometer ensures that the successive lines of dots are printed at substantially equally spaced positions on the mail item.

Drawing of the thermal transfer ribbon from the spool 15 during printing on a mail item causes rotation of the spool 15. However if a fault in feeding of the ribbon should occur, for example due to exhaustion of the supply of ribbon on the spool 15 or due to breakage of the ribbon, the ribbon will cease to exert a rotational force on the spool 15. A slotted disc 33 (see FIG. 1) is driven by rotation of the spool 15 and rotation of the disc 33 is sensed by an opto sensor 34.

Output pulses from the opto sensor 34 are input to the microprocessor 35 via the input/output interface 39. Output pulses from the tachometer 45 are generated at intervals corresponding to 0.125 mm movement of the mail item and for a constant velocity of feed of the mail item these pulses are generated at regular intervals of time.

Figure 3:
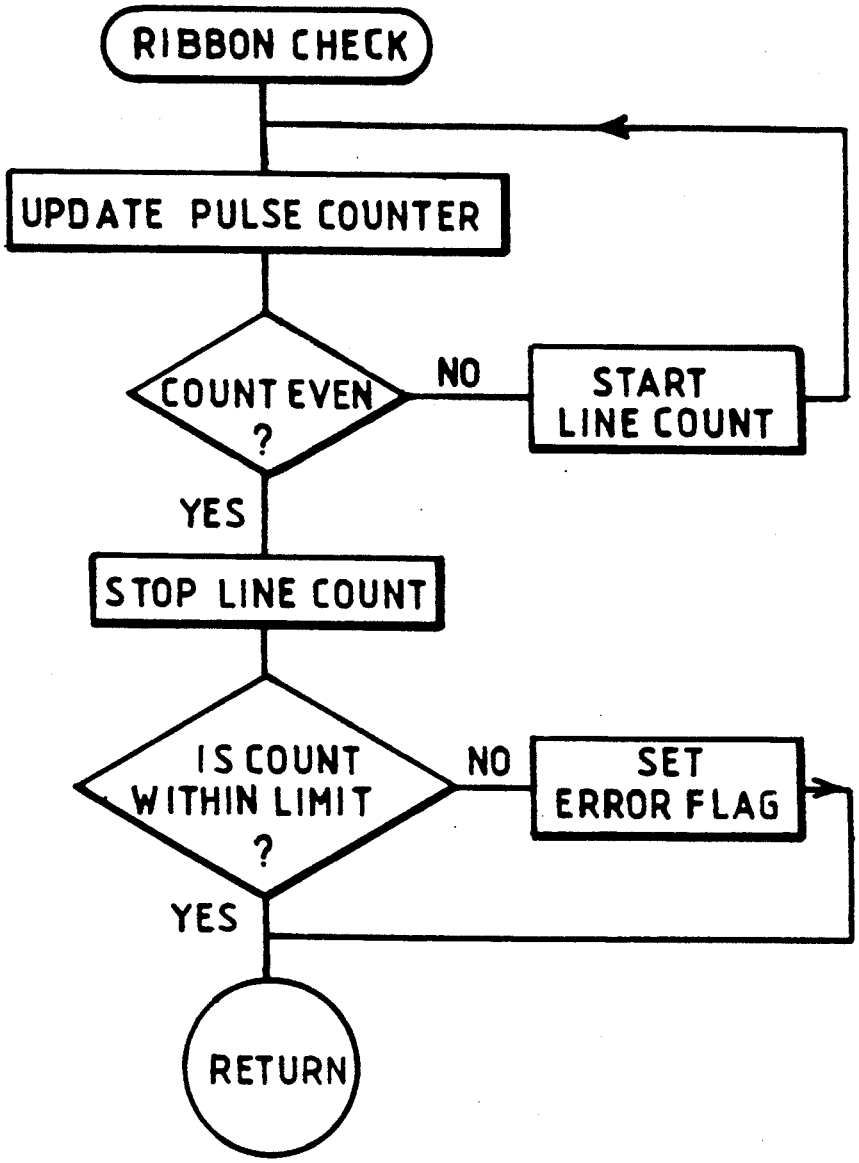
FIG. 3 is a flow chart illustrating a program routine for checking feeding of an ink ribbon.

Output pulses from the opto sensor 34 will be generated at intervals of time determined by the rotation of the spool 15. It will be appreciated that feeding of a length of ribbon from the spool, due to contact between the ribbon and the mail item being fed, will result in rotation of the spool and the angular rotation of the spool for withdrawal of a given length of ribbon therefrom will change progressively as ribbon continues to be drawn from the spool due to the change in diameter of the wound ribbon on the spool. The opto sensor 34 is arranged such that the pulses generated thereby occur at a lower frequency than the frequency of the tachometer pulses for all diameters of wound ribbon on the spool. The microprocessor 35 operating under the control of a program routine checks that the interval between generation of successive pulses by the opto sensor 34 lies within a predetermined maximum time interval. The program routine carried out by the microprocessor 35 is illustrated by the flow chart of FIG. 3. The pulses from the opto sensor 34 are input to a first counter and if the pulse is an odd numbered pulse, in the sequence of pulses from sensor 34, a count of line pulses from the tachometer is started.

When the next pulse, i.e. an even numbered pulse, is received from the sensor 34 the line count is terminated. The microprocessor stores in memory a reference value of line count which is slightly in excess of the number of line pulses which will be received from the tachometer during the interval between a pair of pulses from the sensor 34, when the ribbon feed is operating satisfactorily. The line count actually registered in the interval between an odd numbered pulse and an even numbered pulse from the sensor is compared with the reference line count. If the actual line count is less than the reference line count the routine returns to the start of the routine. However if the actual line count is greater than the reference line count an error flag is set to indicate that the spool 15 is rotating to a less extent than that associated with correct withdrawal of the ribbon from the spool which may be due to the end of the ribbon leaving the spool or a breakage in the ribbon. Setting of the error flag inhibits further operation of the printer and of the franking machine.

Generally it is sufficient to compare the actual line count with a single fixed reference value. However if desired a set of reference values corresponding to a series of different diameters of wound ribbon on the spool may be used. Each franking impression is of the same length and accordingly substantially the same length of ribbon is used in printing each impression. A count may be stored of the number of franking impressions printed from the time that a new ribbon is installed and this will correspond approximately to the diameter of wound ribbon on the spool. The reference values are selected in dependence upon the number of franking impressions printed.

In another variation of checking the feeding of the ribbon, when a new ribbon is installed a line count is obtained for the interval between a first pulse and the next pulse from the sensor 34 and this count is stored. Thereafter line counts obtained in a series of intervals between pulses are compared with the preceding line count. The change in value of the line counts in the series due to change in diameter of the wound ribbon will be relatively small and accordingly a correspondingly small reference difference value is stored for comparison with the difference between consecutive values of line count.

While hereinbefore the interval during which a count of line pulses is effected is defined by consecutive pulses from the sensor 34, it is to be understood that longer intervals may be used which are defined the first and last pulses of a series of pulses.

It is to be understood that the term franking impression is intended to include not only an impression which consists solely of an impression approved by a Postal Authority for franking of mail items but also similar impressions for example for use with parcel carrier services and also to include such impressions which in addition include a logo or advertising material.

We claim:

1. A ribbon feed mechanism including means for drawing an ink ribbon from a spool of wound ribbon past a print head first means responsive to movement of the ribbon past the print head to produce first signals representing increments of movement of the ribbon; second means responsive to rotation of the spool to produce second signals representing increments of angular rotation of the spool and control means operative to count the number of first signals occurring during an interval defined by said second signals and to compare said count with a predetermined reference value.

2. A ribbon feed mechanism as claimed in claim 1 wherein the ribbon is a thermal transfer ink ribbon and the ribbon is fed past the print head by frictional engagement with a print receiving medium fed by feeding means past the print head.

3. A ribbon feed mechanism as claimed in claim 1 wherein said first means comprises a tachometer driven by said feed means.

4. A ribbon feed mechanism as claimed in any claim 1 wherein the second means comprises a disc driven by the spool and an opto-electronic sensor responsive to rotation of the disc.

5. A ribbon feed mechanism as claimed in claim 1 wherein the second means comprises a slotted disc driven by the spool and an opto-electronic sensor responsive to passage of said slots during rotation of the disc.

6. A ribbon feed mechanism as claimed in claim 1 wherein the control means includes memory means storing the predetermined reference value and said control means is operative to start a count of the first signals upon receipt of one of said second signals and to terminate the count upon receipt of the next one of said second signals in a series of second signals and is operative to compare the count with said predetermined reference value stored in said memory means and in response to said count being greater than said predetermined reference value to set an error flag.

7. A ribbon feed mechanism as claimed in claim 6 wherein the control means is operative to store in the memory means a first count of the number of first signals occurring during a first interval defined by two first consecutive second signals, said first count stored in said memory means constituting the predetermined reference value for subsequent use; and wherein the control means is operative to compare a second count of first signals occurring during a second interval, subsequent to said first interval, defined by two second consecutive second signals with said predetermined reference value constituted by said first count stored in said memory means.

8. A ribbon feed mechanism as claimed in claim 1 in combination with a thermal print head including a plurality of selectively heatable thermal printing elements; feeding means to feed a print receiving medium past said plurality of print elements; and print control means operable to selectively heat said thermal printing elements during feeding of said print receiving medium past said printing elements to print an impression of said print receiving medium.

9. A ribbon feed mechanism as claimed in claim 8 wherein the print control means includes accounting means; value input means connected to said accounting means for input of a postage value; and wherein said accounting means is operative to control the selective heating of the printing elements to print an impression including a representation of said input postage value.

10. A ribbon feed mechanism as claimed in claim 8 wherein the print control means is operable to print a series of impressions on a series of print receiving media, equal lengths of ribbon being drawn past the print head for the printing of each impression and including counting means to maintain a count of impressions printed during use of a specific ribbon and wherein the control means is operative to generate the store in memory means a value varying in dependence upon said count of impressions and to use said value as the predetermined reference value.

11. A ribbon feed mechanism including means for feeding a print receiving medium past a print head and for effecting drawing of a thermal transfer ink ribbon from a spool of wound ribbon into ink transfer relationship with said print receiving medium during passage of said print receiving medium past said print head; first means responsive to movement of said print receiving medium past the print head to produce a succession of first signals representing successive increments of movement of said medium; second means responsive to rotation of the spool to produce a pair of second signals spaced by an interval and representing an increment of angular rotation of the spool during said interval; and control means operative during said interval to count the number of first signals occurring during said interval and to compare said count of first signals with a predetermined reference value to provide a ribbon feed indication.

* * * * *